US005142609A

United States Patent [19]

Hilscher et al.

[11] Patent Number: 5,142,609

[45] Date of Patent: Aug. 25, 1992

[54] PLUG-IN QUARTZ INFRA-RED RADIATOR

[75] Inventors: Reinhard Hilscher, Wiesbaden; Christian Ullrich, Bad Homberg, both of Fed. Rep. of Germany

[73] Assignee: TQS Thermal Quarz-Schmelze GmbH, Fed. Rep. of Germany

[21] Appl. No.: 566,372

[22] PCT Filed: Dec. 18, 1989

[86] PCT No.: PCT/DE89/00777

§ 371 Date: Oct. 9, 1990

§ 102(e) Date: Oct. 9, 1990

[87] PCT Pub. No.: WO90/07253

PCT Pub. Date: Jun. 28, 1990

[30] Foreign Application Priority Data

Dec. 18, 1988 [DE] Fed. Rep. of Germany ..... 3842641

[51] Int. Cl.[5] ..... F26B 3/30; H05B 3/00; H05B 3/06; H05B 3/44

[52] U.S. Cl. ..... 392/407; 392/411; 219/541

[58] Field of Search ..... 392/407, 411; 219/541, 219/542, 536-537, 464-465, 451, 463, 467; 439/692-697; 362/217, 224, 268

[56] References Cited

U.S. PATENT DOCUMENTS

| | | | |
|---|---|---|---|
| 2,227,739 | 1/1941 | Pollard | 362/217 |
| 3,005,081 | 10/1961 | Kordes et al. | 219/552 |
| 3,141,086 | 7/1964 | Prager | 392/407 |
| 3,188,459 | 6/1965 | Bridwell | 392/418 |
| 3,253,243 | 5/1966 | Martin | 219/552 |
| 3,305,680 | 2/1967 | Berkl . | |
| 3,309,499 | 3/1967 | Carr . | |
| 3,543,002 | 11/1970 | Poole . | |
| 3,596,057 | 7/1971 | Arniz et al. . | |
| 3,627,989 | 12/1971 | Heidler et al. . | |
| 3,859,554 | 1/1975 | Preziosi et al. | 439/695 |
| 4,161,622 | 7/1979 | Drayer . | |
| 4,406,944 | 9/1983 | Crain et al. | 219/541 |
| 4,531,047 | 7/1985 | Canfield et al. . | |
| 4,556,786 | 12/1985 | Frost et al. | 219/462 |
| 4,700,051 | 10/1987 | Goessler et al. | 219/464 |
| 4,894,519 | 1/1990 | Notelteirs | 219/464 |

FOREIGN PATENT DOCUMENTS

| | | | |
|---|---|---|---|
| 213315 | 3/1958 | Australia | 362/217 |
| 0201325 | 12/1986 | European Pat. Off. . | |
| 1202408 | 10/1965 | Fed. Rep. of Germany | 219/541 |
| 3619919 | 1/1988 | Fed. Rep. of Germany . | |
| 2382146 | 9/1978 | France . | |
| 1089471 | 11/1967 | United Kingdom | 392/407 |

*Primary Examiner*—Bruce A. Reynolds
*Assistant Examiner*—John A. Jeffery
*Attorney, Agent, or Firm*—Biebel & French

[57] ABSTRACT

A quartz infra-red radiator comprises a housing (1) and has disposed therein at least one heating element (2), electrical connections (3), plug connections (4, 5) on the back of the housing and with a heat-resistant insulating holder (6) for the heating element. In order to produce such a plug-in quartz infra-red radiator more easily and at a more competitive price, the heat-resistant insulating holder (6) comprises a space (7) to hold at least a part of a plug-in connection (5) and at least an aperture through which it is possible to pass a part of a plug connection (5) which is housed in the space (7) and which protrudes from the housing (1).

16 Claims, 6 Drawing Sheets

13'
6"
13'

6"
13'

4D
6"
4E
8"
8"
4D
4E
7"

6"
7"
8"
7
7'
8'
8

7"

PLUG-IN QUARTZ INFRA-RED RADIATOR

BACKGROUND OF THE INVENTION

The present invention relates to a plug-in quartz infra-red radiator with a housing and, disposed therein, at least one heating element, with electrical connections, plug-in connections on the back of the housing and with a heat-resistant insulating holder for the heating element or heating elements in the housing.

Such a quartz infra-red radiator is known from DE-OS 36 19 919. In the case of the prior art quartz infra-red radiator, both mechanical and also electrical plug-in connections are disposed independently of one another on the back of the housing. It is true that the plug-in facility of the quartz infra-red radiator, when compared with the hitherto conventional complicated wiring arrangement, does already provide tremendous advantages, yet with the prior art plug-in quartz infra-red radiators the electrical connections of the heating elements are still in conventional manner led out of an insulating support for the heating elements to the plug-in contacts disposed on the back of the housing where they are connected to the associated part of a plug or of a socket. The electrical plug-in connection on the back of the housing must thereby, as a rule, provide a heat-resistant electrical insulation for the connection to the electrical connections of the heating elements and which, in accordance with conventional requirements in terms of heat resistance, insulating capacity and mechanical properties, constitutes the provision of a ceramic housing for the plug-in connection. The disposition and attachment of such a plug-in connection with a ceramic housing on the back of an infra-red radiator means additional expense when producing the quartz infra-red radiator which would otherwise have on the back purely a row of ceramic sleeve insulated connecting wires.

In contrast, the present invention is based on the problem of providing a plug-in quartz infra-red radiator having the features mentioned at the outset but which, when compared with the prior art plug-in quartz infra-red radiators, can be produced more easily and at a more competitive price.

SUMMARY OF THE INVENTION

This problem is resolved in that the heat-resistant insulating holder comprises a space to accommodate at least a part of a plug-in connection and at least one aperture for leading through a part of a plug-in connection which is not accommodated in the space and which preferably protrudes therefrom at the back of the housing.

Consequently, the function of a likewise heat-resistant holder which in any event is provided for the heating elements of the quartz infra-red radiator is advantageously combined with that of a holder for the plug-in connection so that a part of the plug-in connection is accommodated and supported in the space provided for it in the heating element holder, while another part of the plug-in connection extends from this space through the aperture which is likewise provided on the holder, emerging at the back of the housing so that this projecting part can be fitted together with a matching counterpart which is for example disposed on an assembly plate. However, it is also possible for a part of a plug-in connection to extend from the assembly plate in the direction of the infra-red radiator and which, when connected to the infra-red radiator, is pushed into the aperture so that a connection is established with the part of the plug-in connection which is housed in the space of the holder.

Certainly, an embodiment of the invention is preferred in which the projecting part of the plug-in connection and the part of the plug-in connection which is accommodated in the space of the holder are connected to each other in one piece.

In particular, an embodiment of the invention is preferred in which these plug-in connection parts form a flat plug which is angled over to an L-shape, of which the first leg is completely housed in the space in the holder which is provided for it while its second leg extends through the aperture in the holder, emerges at the back of the housing and can be plugged together with a matching counterpart.

By reason of the different aforesaid possibilities, therefore, the term "plug-in connection" within the meaning of this application must be so interpreted that it covers both the connection consisting of a socket and a plug and also a plug or a socket by themselves, in so far as they consist of a part which is accommodated in the space of the holder and a part which projects from the holder and also from the back of the housing.

It is expedient if the holder according to the present invention has space for parts of two plug-in connections. It is well known that an electrical heating element needs two electrical connections which expediently end at one and the same holder and which merge into the two plug-in connections disposed on this holder. Of course, it is however also possible in the case of a quartz infra-red radiator having a plurality of holders for heating elements to provide one of the above-mentioned plug-in connections at each of these holders. Also the preferred embodiment of an infra-red radiator according to the present invention has, disposed on opposite side walls of a housing, two holders for heating elements, although only one of these holders has both the necessary plug-in connections. Regardless of this, however, the two oppositely disposed holders or parts thereof may be identically formed and may have the appropriate space to accommodate plug-in connections without plug-in connections having to be provided also on both holders. This may be sensible particularly on production grounds, since in this way it is possible to reduce the number of parts which have to be differently produced.

It is particularly advantageous if according to the invention the holder on one side of the housing is made in two parts, both parts being in the readily installed state flush with one another and having in their bearing surfaces recesses which are opposite one another, so defining the space for the parts of plug-in connections. Where such an embodiment is concerned, both parts of a holder are separated and then the corresponding parts of a plug-in connection are simply inserted from the bearing surface into the recesses provided therein and the second part of the holder has its recesses so fitted over them that the parts of the plug-in connection are accommodated in the space formed by the oppositely disposed recesses. It is also expedient if from the recesses at least one respective slot extends as far as that side of the parts of the holder which are at the back of the housing, so providing an aperture through which it is possible to lead a part of the plug-in connection from the space to the outside of the housing.

Also the aforesaid L-shaped angled-over flat plug can have one leg so inserted into the corresponding space from the bearing surface of one of the parts, the other arm of the L-shaped angled-over plug then extending outwardly through the slot. As soon as the two parts of the holder, with the inserted plug-in connection parts bear on one another, they are inserted into the housing and are fixed in this condition.

Preferably, the holder consists of ceramic material since ceramic is a very readily heat-resistant and at the same time electrically readily insulating material which has sufficient mechanical strength both to accommodate and support the heating elements and also the plug parts.

If the housing has a continuous rear wall, then it goes without saying that at the height of the holder it is necessary to provide at least one aperture in the rear wall of the housing, it being particularly advantageous if at least one lug extends from the edge of the aperture and parallel with and at a distance from the opposite side walls of the housing and into the interior of the housing. This lug may be used for attachment of the holder.

It is particularly advantageous if the distance between the lug and a side wall corresponds to the thickness of the holder, the aperture in the rear wall of the housing being disposed between the lug and this side wall. The holder can be so fittingly inserted between the lug and a side wall of the housing, a part of its side which is towards the rear wall lying exactly over or under the aperture in the rear wall of the housing, so that it is possible at this point to provide plug parts which project beyond the housing.

According to a preferred embodiment of the invention, the holder comprises at least one continuous transverse aperture which extends substantially parallel with the rear wall of the housing and the heating element or elements. Through such a transverse aperture may extend fixing elements to the side wall of the housing or to a lug. In such a case, it is particularly suitable if the lug and the side wall comprise apertures aligned with each other and with the continuous transverse aperture so that in this way the holder can easily be rigidly riveted on the lug and the side wall of the housing. It is possible thus advantageously to avoid the ends of the rivets pressing directly on the holder which particularly in the case of ceramic holders can easily result in their breaking. In the case of the aforementioned preferred embodiment, however, the two ends of the rivet engage the side wall or a lug, being pressed on the intermediate holder while at the same time distributing over a relatively large area of the holder the forces exerted by the rivet. In addition, the transverse aperture in the holder can also be reinforced by a metal sleeve.

Where the two-part embodiment of the holder is concerned, it is particularly advantageous if the part bearing on the side wall of the housing is in the direction at right-angles to the rear wall of the housing wider than the other part of the holder and if it has in its projecting portion a housing to accommodate heating elements.

The space to accommodate parts of the plug-in connection then lies in the region in which the two parts of the holder bear on each other while independently of this, there is in the projecting portion of one part of the holder a housing for the heating elements. This part which bears on the side wall and which has the housing for the heating elements can then, regardless of the disposition of parts of the plug-in connection, also be used as a conventional holder for heating elements. If, then, it is desired to dispose plug elements on the holder, then simply the second part of a holder is added which must be disposed in the region in which it is adjacent the rear wall of the housing, since plug parts ought to extend through the rear wall of the housing. The space to accommodate the plug-in connection and the corresponding parts of the holder therefore lie in the region between the heating elements and the rear wall of the housing.

Preferably, the electrical connections of the heating elements are connected directly to parts of plug-in connections which are accommodated in the space of the holder, preferably by welding. In any event, the connection must be sufficiently heat-resistant and electrically safe. However, it has been found that heat dissipation through such plug-in connections is sufficiently good so that the temperatures at the plug contacts remain below 300° C. so that it is possible to produce a plug-in connection with commercially available flat plugs.

In addition to the electrical plug-in connection, the preferred embodiment of the invention also has, disposed on the rear wall of the housing, a mechanical plug journal which can be plugged in by means of a resilient plug socket which is disposed for example at a suitable distance from the electrical plug parts on an assembly plate.

For the electrical connection of a plug-in connection part which is accommodated in the holder, with a heating element, there are of course also provided recesses, connecting passages, apertures or the like between the housing for the heating elements and the space in the holder which accommodates the plug-in connection part.

Further advantages, features and possible applications of the present invention will become clearly apparent from the ensuing description of a preferred embodiment and of the associated drawings in which:

DESCRIPTION OF THE PREFERRED EMBODIMENT

Figure 1:
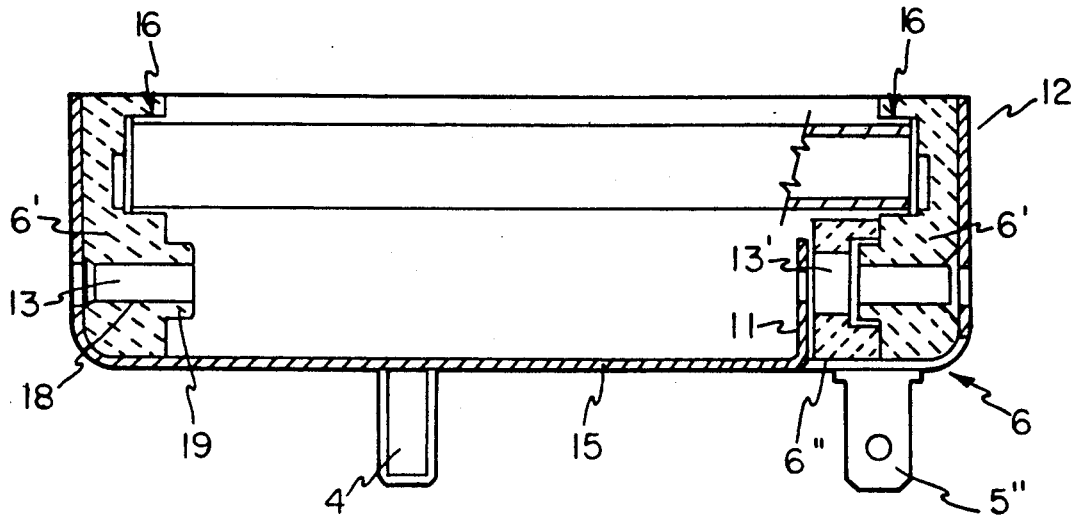
FIG. 1 shows a longitudinal section through a quartz infra-red radiator.
Figure 2:
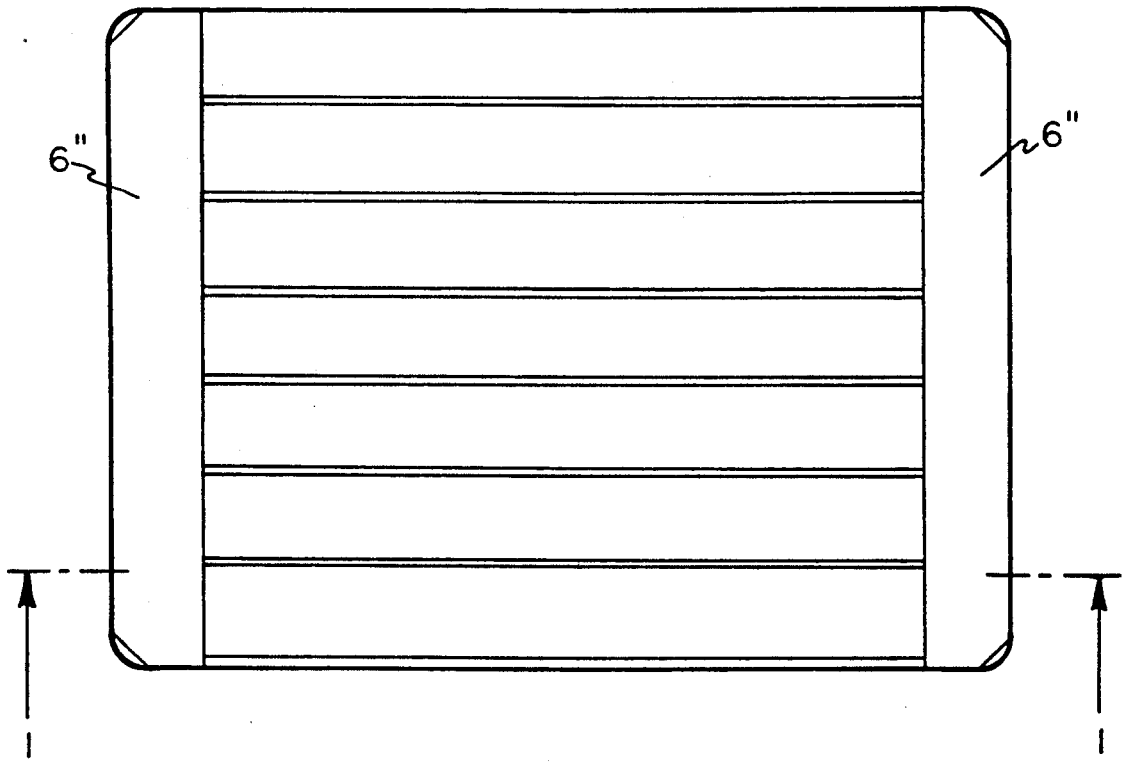
FIG. 2 is a view of the infra-red radiator from the front.

FIGS. 1 and 2 show heating elements 2 which consist of quartz tubes in which there is a filament which consists of an electrical heating wire. The quartz tubes or heating elements 2 are supported in recesses or holders 16 provided in the parts 6' of a holder 6. The parts 6' of the holder 6 are disposed on oppositely disposed side walls 12 of the housing 1 of a quartz infra-red radiator.

The holder 6 shown on the right-hand side of FIG. 1 consists of two parts 6', and 6'', the part 6' being in the direction at right-angles to the bottom 15 of the housing 1 broader or higher than the part 6'' so that the heating elements 2, extending beyond the part 6", project into the housing 16 of the part 6'. Extending transversely through the parts 6' and 6" are bores 13, 13' which are substantially parallel with the heating element 2. Around the bore 13, the part 6' has a cylindrical projection 19 which engages in fitting manner into a radial widened out part of the bore 13' at the part 6" so that after engagement the two parts 6' and 6" are fixed in relation to each other. Disposed in the transverse aperture 13 of the part 6' is a metal sleeve 18 which has a flange projecting beyond the extension 19 so that the part 6' can be directly attached by a rivet to the side wall 12 of the housing 1.

In the assembled state, the two-part holder 6 is inserted between a side wall 12 and a lug 11 which is bent upwardly from the bottom 15 of the housing 1 so that the parts 6' and 6" are in rigid engagement with one another. It is likewise possible to provide a rivet for fixing the holder 6, passing it through the bores 13' and 13 as well as through the aligned apertures 14, 14' on the housing 1 or lug 11.

FIG. 2 shows quite a number of heating elements 2 can be disposed beside one another in a housing 1 of a quartz infra-red radiator.

Figure 3D:
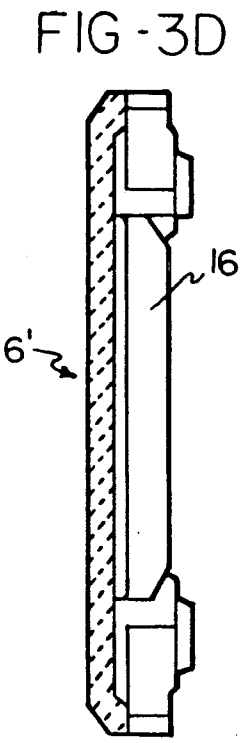
FIGS. 3*a–f* show various views of a first holder part.
Figure 3C:
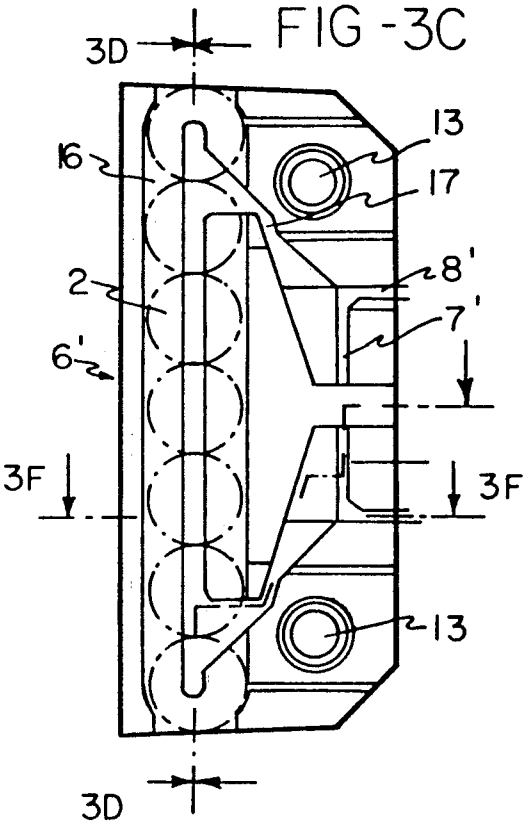
Figure 3F:
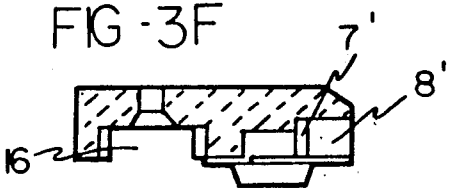
Figure 3B:
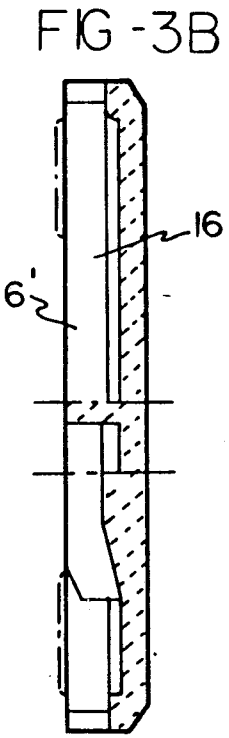
Figure 3A:
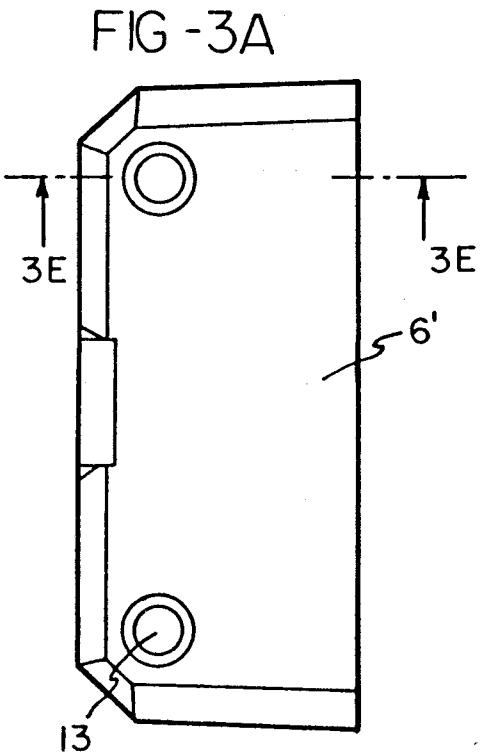
Figure 3E:
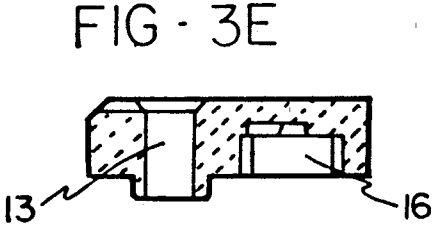
Figure 6:
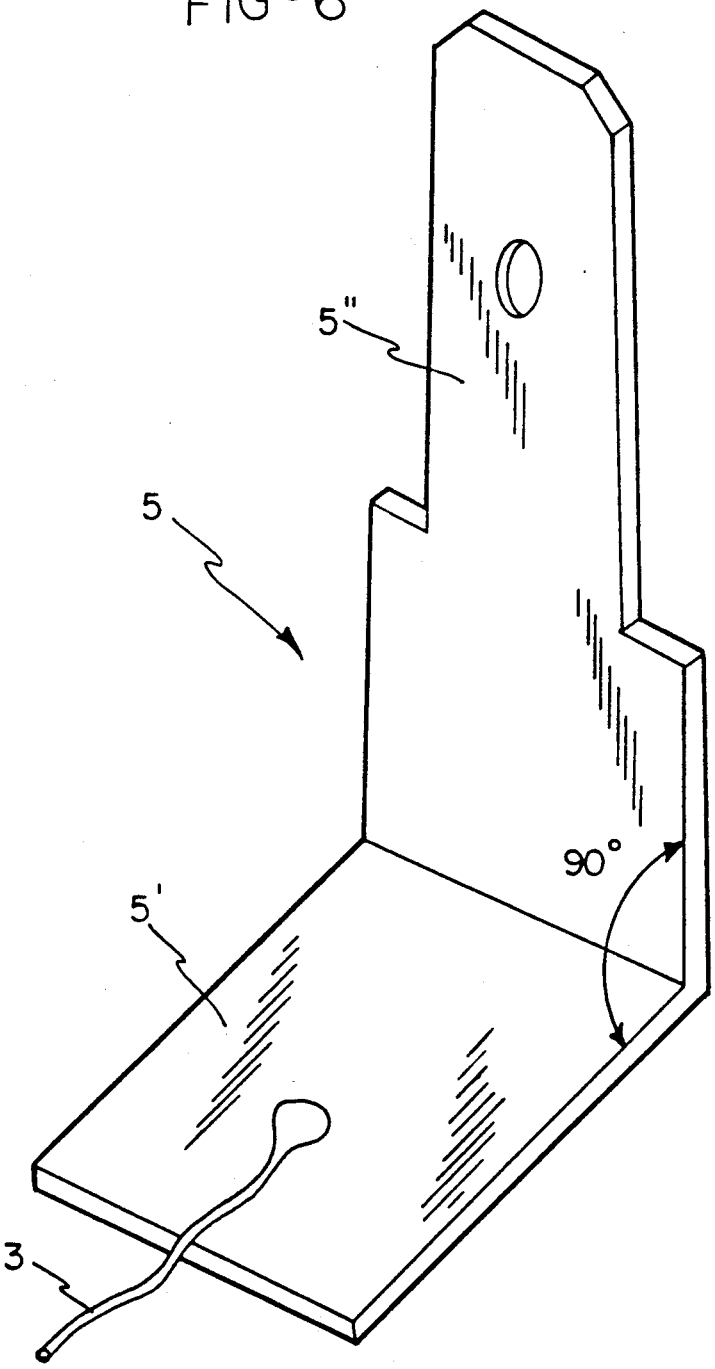
FIG. 6 shows a perspective view of a flat plug for insertion in to a holder and FIGS. 7*a–c* show various views of a counterpart for the flat plug according to FIG. 6.

FIGS. 3*a–f* show various views or sectional views of the part 6' of the holder 6. In FIG. 3*a*, the part 6' is shown from the side which bears on the side wall 12. A more accurate impression is provided by the view in FIG. 3*c* which is a view of the part 6' seen from the inside of the housing 1. Diagrammatically shown are heating elements 2 which are in the housing 16 which can also be seen in cross-section in FIGS. *e* and *f*. The housing 16 is connected by a passage 17 to the recess 7' or the slot 8' which, in the completely installed state, are opposite corresponding recesses 7" and 8", so forming a space 7 and an aperture 8 for accommodating and leading through parts of a plug-in connection. Extending inside the heating element 16 are conventionally series connected coiled electrical heating wires the terminal connections of which are passed through the passage 17 to in each case an arm 5' of a plug-in connection 5 to which they are welded, as shown in FIG. 6. The plug-in connection 5 has its arm 5' in the recess 7' while its arm 5" projects into the recess 8' while its flat plug part protrudes from the slot 8' of the part 6 in the view in FIG. 3*c* rightwardly. The part 6' is in mirror symmetrical relationship of a median plane extending horizontally in respect of FIG. 3*c*. Therefore, to the right and left of this plane, there are in each case a recess 7' and a slot 8' as well as a passage 17 to accommodate the plug-in connection 5 and the electrical connections 3.

Figures 4A, 4B, 4C, 4D, 4E:
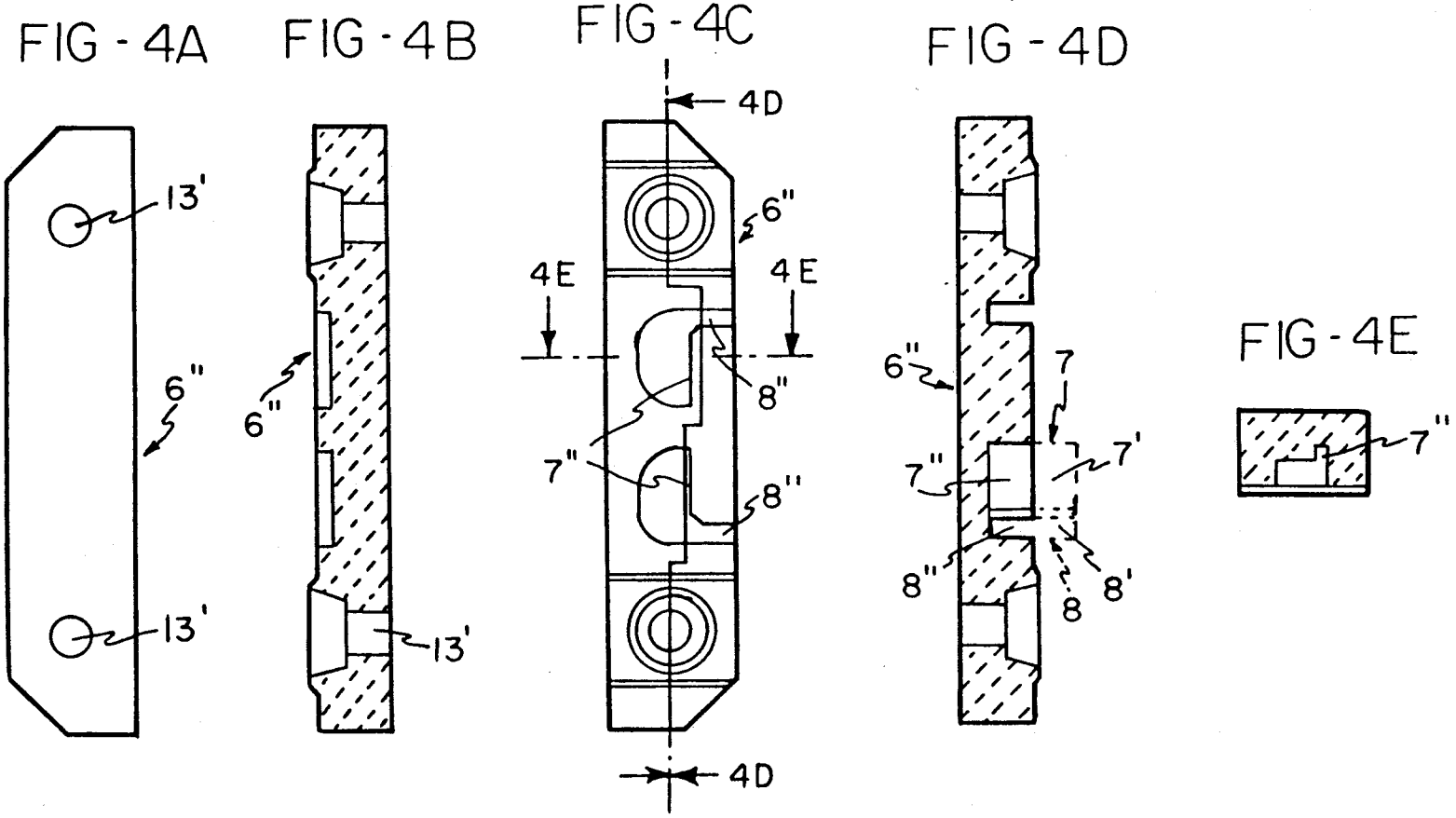
FIGS. 4*a–e* show various views of a second holder part.

FIG. 4 shows the part 6' of the holder 6 which, as can also be seen in FIG. 1, is narrower than the part 6'. However, also the part 6" like the part 6' has mirror symmetrically disposed recesses 7" and slots 8" which in the completely assembled state are opposite the corresponding recesses 7' and slots 8' in the part 6' so forming the cavity 7 or the aperture 8 as indicated by broken lines in FIG. 4*d*. The space accommodates the arm 5' of the plug-in connection 5 while the arm 5' extends outwardly through the aperture 8. FIGS. 4*a–d* show clearly the transverse apertures 13', FIG. 4*b* furthermore showing that the already mentioned radial widening of the bore 13' is not exactly cylindrical but is slightly conical and so facilitates inter-fitment of the parts 6' and 6".

Figure 5A:
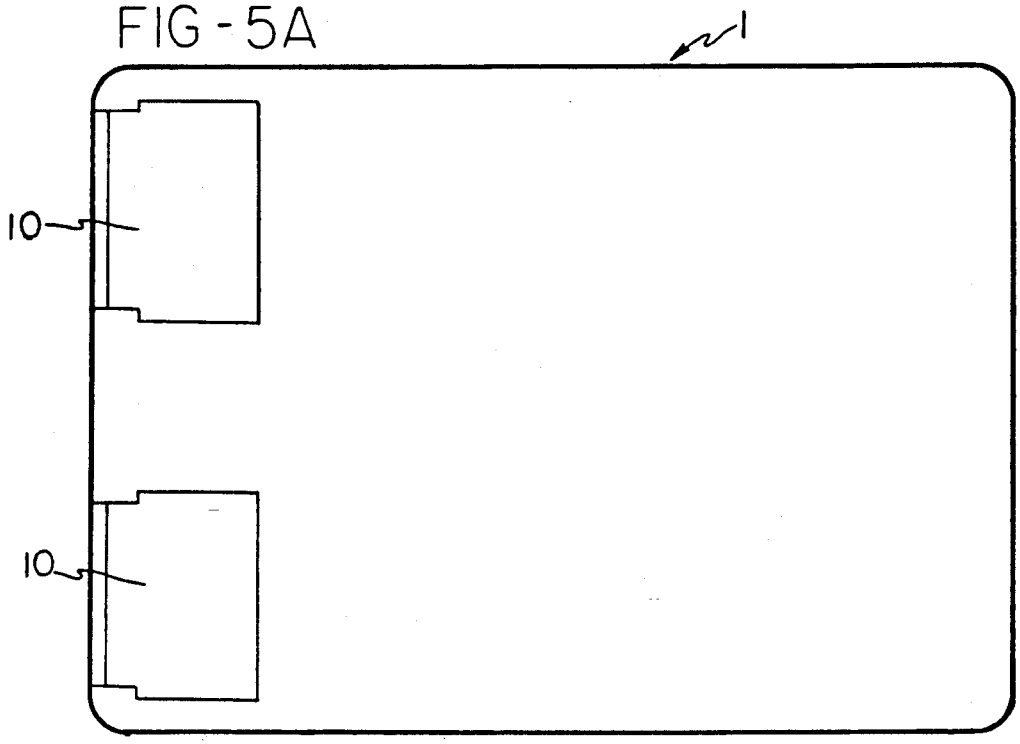
FIGS. 5*a–c* show various views of the housing.
Figure 5B:
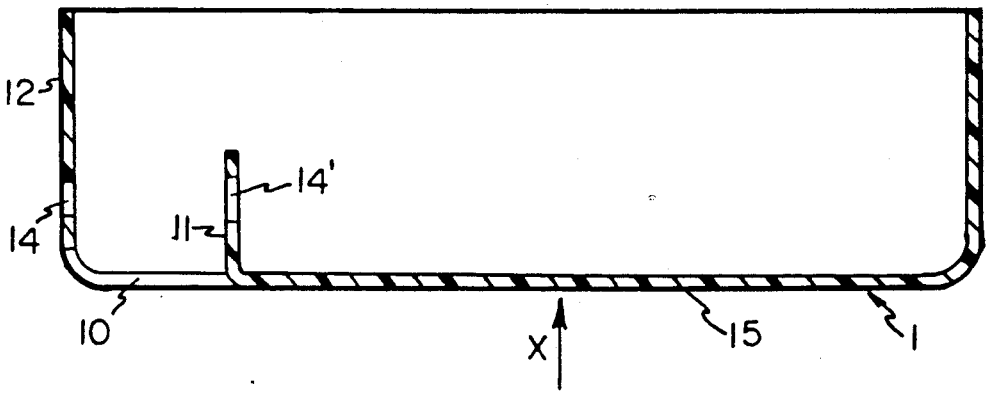
Figure 5C:
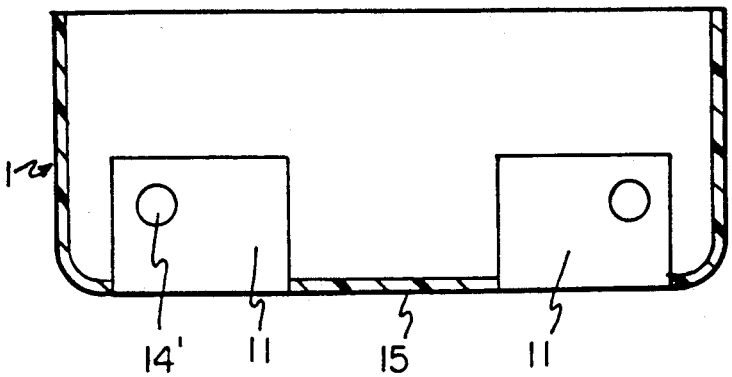

FIGS. 5*a–c* show only the housing 1. It can be seen that two apertures 10 are stamped out of the bottom of this, the material of the bottom 15 of the housing which is on the farthest inwards edge of the aperture 10 not being completely stamped off but remaining in the form of a lug bent over at an angle of substantially 90° to the bottom 15 of the housing 1. The lug comprises a bore 14' which is aligned with a bore 14 provided in the side wall 12. Also the side wall opposite the side wall 12 comprises a corresponding bore for a riveted attachment of the part 6' while in the space between the lugs 11 and the side wall 12 the assembled parts 6' and 6" can be inserted in a substantially fitting manner.

The peg or plug-in projection 4 shown in FIG. 1 can be constructed either in the form an otherwise commercially available retaining peg or it may be provided with an external screw thread so that it can be screwed into the interior of a retaining peg which is provided with a corresponding internal screw thread. Normally, such retaining threads have in the bottom a hexagonal projection so that they can easily be screwed onto an appropriate screw-threaded peg. Such a retaining peg furthermore has a point for insertion between spring clips and a tapering neck behind the conical point so that the retaining peg is gripped with a predetermined force by appropriate retaining clips engaging the restriction which is thus formed.

Figure 7A:
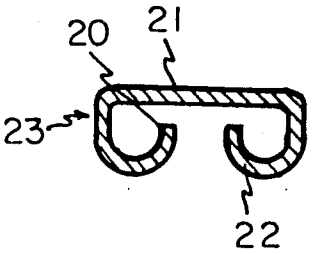
Figure 7C:
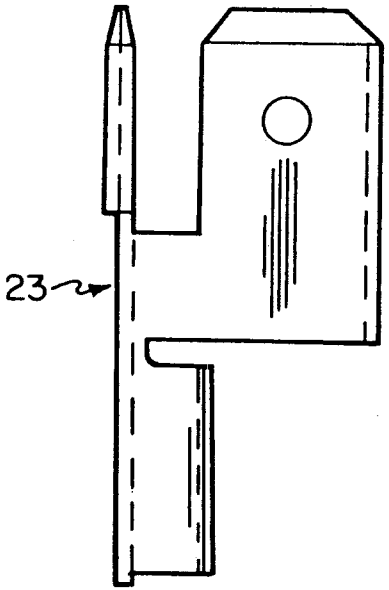
Figure 7B:
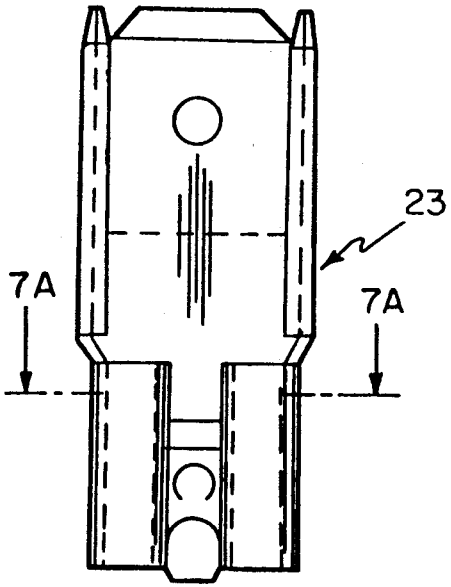

Mostly, quartz infra-red radiators are disposed in a relatively large number on a mounting plate so that on the mounting plate, arranged in an appropriate grid pattern, it is possible to provide spring clips for such retaining pegs and plug-in projections for the electrical plug-in connection parts 5" which project from the apertures 8 and 10 at the back of the housing. Such an electrical plug-in connection is shown in FIG. 7 where the flat plug part 5' is pushed into the space 20 between the rear wall 21 and the bent over contact flanks 22 of a plug-in connection 23. For its part, the plug-in connection 23 has at the other end three further flat plug connections which can be used both for further contacting and wiring of a plurality of infra-red radiators inter se but they can at the same time also serve as cooling surfaces to dissipate heat which passes from the heating elements 2 via the plug-in connection 5 to the plug-in connection 23.

Compared with the prior art plug-in infra-red radiators, the new quartz infra-red radiator is more simple in construction and more easily manufactured. It is only necessary somewhat to re-configure the holders 6 which are in any case required for the heating elements 2 so that they can serve at the same time as holders for plug-in connections 5.

We claim:

1. A quartz infra-red radiator with a housing (1) and comprising plug-in connections (4, 5) on the back of the housing and with a heat-resistant, electrically insulating holder (6) for receiving a first and second end of at least one heating element (2) and for securing said at least one heating element (2) in said housing (1), characterised in that the holder (6) defines a space (7) to accommodate at least a part of a plug-in connection (5) and at least one aperture (8) for leading through a part of a plug-in connection (5) which is not accommodated in the space (7) such that said plug-in connection protrudes from the back of the housing (1); said plug-in connections (4, 5) being generally flat; said at least one heating element (2) being integrally coupled to said plug-in connector via an electrical connection (3).

2. An infra-red radiator according to claim 1, characterised in that the plug-in connection (5) is a unitary, one-piece construction.

3. An infra-red radiator according to claim 1 characterised in that the plug-in connection (5) is an L-shaped angled-over flat plug, of which the first leg (5') is completely housed in the space (7) provided for said first leg (5') in the holder (6) wherein the second leg (5'') passes through the aperture (8) in the holder (6) and emerges on the back of the housing (1).

4. An infra-red radiator according to claim 1, characterised in that the holder (6) has space (7) for a portion of two plug-in connections (5).

5. An infra-red radiator according to claim 1, characterised in that the holder (6) is on one side of the housing, said holder (6) constructed in two parts, both parts (6'), (6'') having surfaces which bear on each other in the readily installed state and having in these bearing surfaces recesses (7, 7'') which are opposite each other and so define the space (7) for portions of plug-in connections (5).

6. An infra-red radiator according to claim 5 characterised in that from each of the recesses (7', 7''), at least one slot (8', 8'') extends to that side of the holder (6) which is towards the rear wall of the housing, thereby forming an aperture through which plug-in connection portions can be passed.

7. An infra-red radiator according to claim 1, characterised in that the holder (6) consists of ceramic material.

8. An infra-red radiator according to claim 1, characterised in that there is at least one aperture (10) in the rear wall (15) of the housing, and at least one lug (11) extending into the interior of the housing from the edge of the aperture (10) and parallel with and at a distance from oppositely disposed side walls of the housing (1).

9. An infra-red radiator according to claim 8, characterised in that the distance between the lug (11) and a side wall (12) corresponds to the thickness of the holder (6), the aperture (10) being disposed in the rear wall (15) of the housing between the lug (11) and said side wall (12).

10. An infra-red radiator according to claim 9, characterised in that, for riveted fixing, the holder (6) comprises at least one continuous transverse aperture (13) which extends substantially parallel with the rear wall (15) of the housing and with the heating element (2).

11. An infra-red radiator according to claim 10, characterised in that the lug (11) and the side wall (12) comprise, for riveted fixing of the holder (6) on the housing (1), apertures (14) aligned with one another and with the continuous transverse aperture (13).

12. An infra-red radiator according to claim 11 characterised in that the part (6') of the holder (6) which bears on the side wall (12) of the housing is in the direction at right-angles to the rear wall (15) of the housing, said part (6') having a projecting portion which extends beyond said part (6'') which in a side-by-side relationship and which comprises a housing (16) for receiving heating elements or quartz tubes (2).

13. An infra-red radiator according to claim 1, characterised in that the electrical connections (3) of the heating element (2) are directly connected preferably by welding to plug-in connection parts (5') accommodated in the space (7) in the holder (6).

14. An infra-red radiator according to claim 1, characterised in that there is on the holder (6) at least one connecting passage (17) through which it is possible to pass an electrical connection (3) from the heating element (2) to the plug-in connection part (5) which is housed in the space (7).

15. An infra-red radiator according to claim 9, characterised in that there is on the back of the housing (1) a peg (4) which is either constructed as a retaining peg or comprises means for holding a mechanical plug-in connecting part.

16. A quartz infra-red radiator comprising:

a housing;

at least one heating element having a first end and a second end;

a heat-resistant, electrically insulating holder for mounting in said housing, said heat-resistant, electrically insulating holder being capable of receiving said first and second ends in order to secure said at least one heating element in said housing;

a generally flat plug-in connector; and an electrical connection for coupling said at least one heating element to said plug-in connector;

said heat-resistant, electrically insulating holder defining a space for accommodating a part of said generally flat plug-in connector in order to secure said generally flat plug-in connector therein such that a second part of said plug in connector can protrude from an aperture in the housing.

* * * * *